United States Patent [19]

Morse

[11] 4,032,151

[45] June 28, 1977

[54] GAME BOARD APPARATUS

[76] Inventor: Harold F. Morse, 1765 Gilpin St., Denver, Colo. 80218

[22] Filed: June 10, 1976

[21] Appl. No.: 694,724

[52] U.S. Cl. ..... 273/131 B
[51] Int. Cl.[2] ..... A63F 3/00
[58] Field of Search ..... 273/131, 132, 134, 130

[56] References Cited

FOREIGN PATENTS OR APPLICATIONS

| | | | |
|---|---|---|---|
| 12,750 | 4/1894 | United Kingdom | 273/130 F |
| 104,092 | 2/1917 | United Kingdom | 273/131 B |

*Primary Examiner*—Delbert B. Lowe
*Attorney, Agent, or Firm*—Munroe H. Hamilton

[57] ABSTRACT

A game playable by two opposing players consists of a playing board having two opposite playing sides and two sets of game pieces which occur in uniformly graduated lengths. The playing board is formed with two sets of slideways in which game pieces may be received and moved about. The two sets of slideways are arranged in uniformly spaced apart relation with the slideways of one set occurring at right angles to the second set so that the game pieces may be placed in slideways of either set and moved in two directions. Game pieces of each set of graduated lengths differ progressively one from another by a unit dimension corresponding to the width of a slideway. Differing combinations of game pieces selected by each opposing player in alternate moves may be arranged in the slideways in abutting relationship to one another and so as to extend from one playing side to the opposite playing side. The player first achieving such an arrangement of abutting pieces extending from one playing side to an opposite playing side, either directly or indirectly, has a game-winning placement.

8 Claims, 35 Drawing Figures

FIG. 3
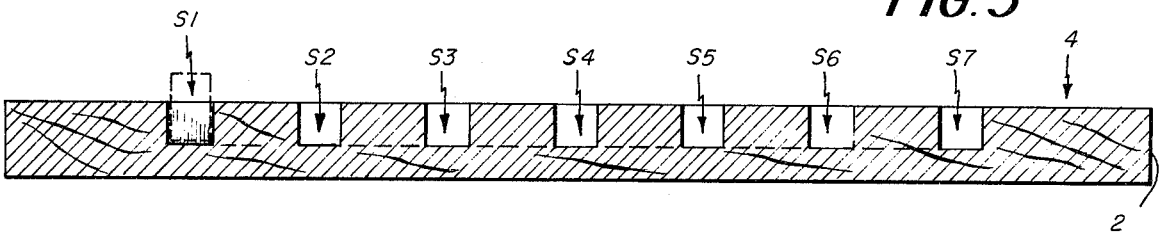
FIG. 4
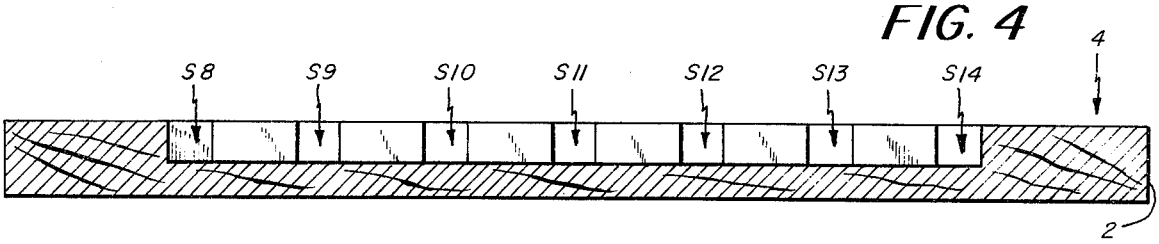
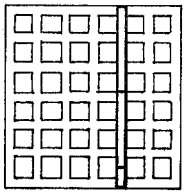
FIG. 5
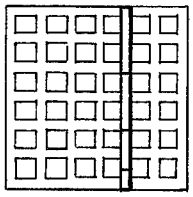
FIG. 6
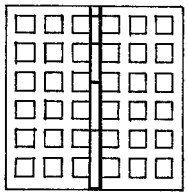
FIG. 7
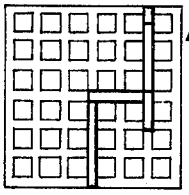
FIG. 8
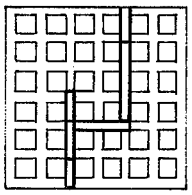
FIG. 9
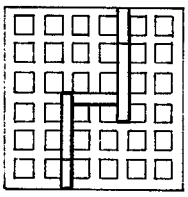
FIG. 10
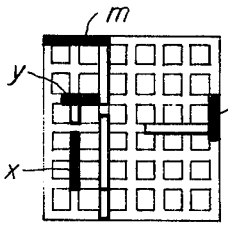
FIG. 11
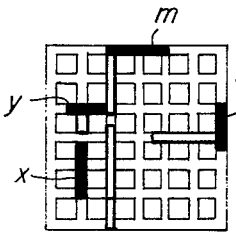
FIG. 12
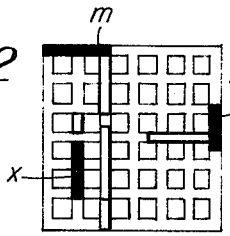
FIG. 13
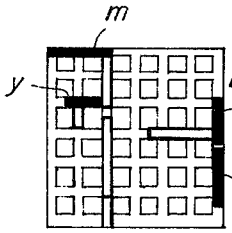
FIG. 14
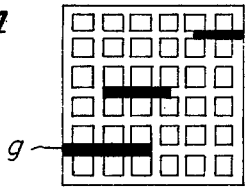
FIG. 15
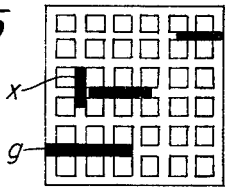
FIG. 16

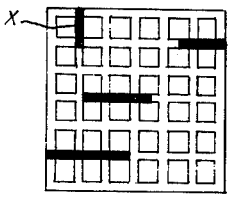
FIG. 17
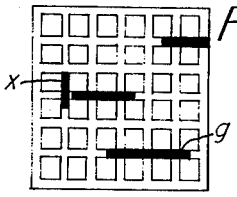
FIG. 18
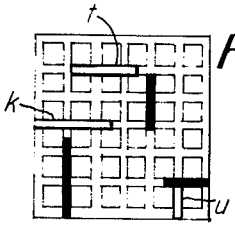
FIG. 19
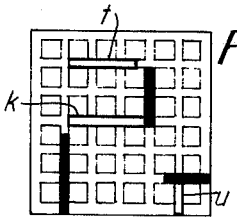
FIG. 20
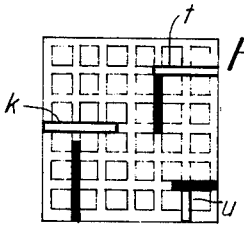
FIG. 21
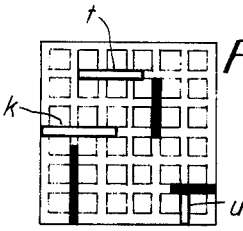
FIG. 22
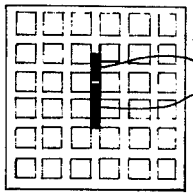
FIG. 23
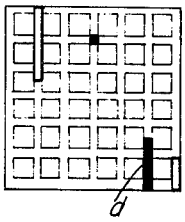
FIG. 24
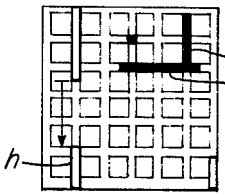
FIG. 25
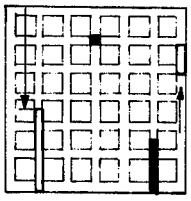
FIG. 26
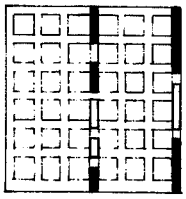
FIG. 27
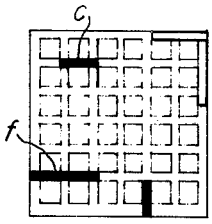
FIG. 28
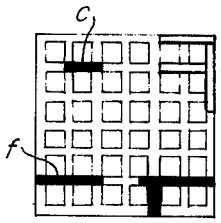
FIG. 29
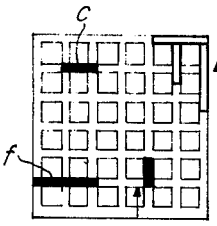
FIG. 30
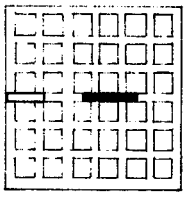
FIG. 31
FIG. 32
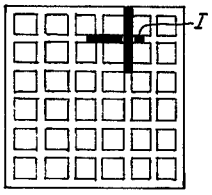
FIG. 33
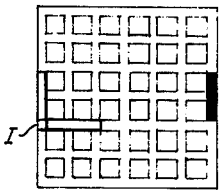
FIG. 34
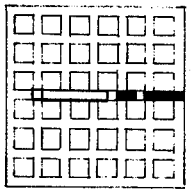
FIG. 35
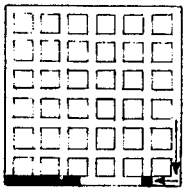

GAME BOARD APPARATUS

BACKGROUND OF THE INVENTION

In the art, various types of games have been proposed based on the use of a playing board and sets of game pieces movable on the board. Games of this general nature are disclosed in U.S. Pat. No. 1,700,016 in which is described an improved checkerboard; also U.S. Pat. No. 3,130,972 which discloses a game board with intersecting channels; and also U.S. Pat. No. 3,402,934 which is concerned with a puzzle game where pieces of varying lengths are fitted together to achieve a pattern having an appearance of a desirable nature.

SUMMARIZATION OF THE INVENTION

The present invention relates to an improved game which makes use of a game board and two special sets of game pieces which are so constructed and designed as to draw upon the logic and creative abilities of a player in selecting and manipulating different dimensional combinations of game pieces on the playing board so as to arrive at a game-winning placement of the game pieces. It is also an object of the invention to devise an improved game of the class including a playing board having slideways and sets of game pieces which are engageable in the slideways and which are of uniformly graduated lengths to provide novel degrees of extension of the game piece dimensions.

With these objectives in mind, I have devised a game board formed with slideways of a predetermined magnitude. In combination with the game board, I have provided two sets of game pieces which occur in graduated lengths, with game pieces of each graduated set differing progressively one from another by a unit dimension which is equal to the width of any one of the slideways. By means of these playing components and their dimensional relationship to one another, different combinations of pieces may be selected by each player in successive moves, and the pieces placed in abutting relationship to one another. The player who first succeeds in arranging abutting game pieces which extend from one playing side of the board to an opposite playing side of the board achieves a game-winning placement.

BRIEF DESCRIPTION OF THE DRAWINGS

FIG. 3 is a cross section taken on the line 3—3 of FIG. 2.

FIG. 4 is another cross section taken on the line 4—4 of FIG. 2.

FIG. 5 is a diagrammatic view illustrating one typical selection of game pieces arranged in alignment with one another between the two playing sides, and occurring in abutting relationship to one another and the playing sides to constitute a game-winning placement.

FIGS. 6 and 7 are similar diagrammatic views, but illustrating differing combinations of game piece lengths taken from one of the sets.

FIGS. 8, 9 and 10 are diagrammatic views illustrating game pieces arranged in staggered relation rather than in alignment, but in abutting relation to one another and to two opposite playing sides to also constitute a game-winning placement of pieces.

FIGS. 11 – 14 are diagrammatic views illustrating player moves which can be carried out by a player in picking up and placing game pieces.

FIGS. 15 – 26 are diagrammatic views illustrating variations of slide moves which can be made by a player. FIGS. 27 – 33 are diagrammatic views illustrating permissible arrangements of game pieces of each set and also indicating moves which are not allowed.

FIG. 34 is a diagrammatic view illustrating an arrangement of game pieces in a middle slideway where some restrictions are not in effect in accordance with the game rules.

FIG. 35 is a diagrammatic view illustrating a move around a corner of the playing board.

DETAILED DESCRIPTION OF THE INVENTION

Figure 1:
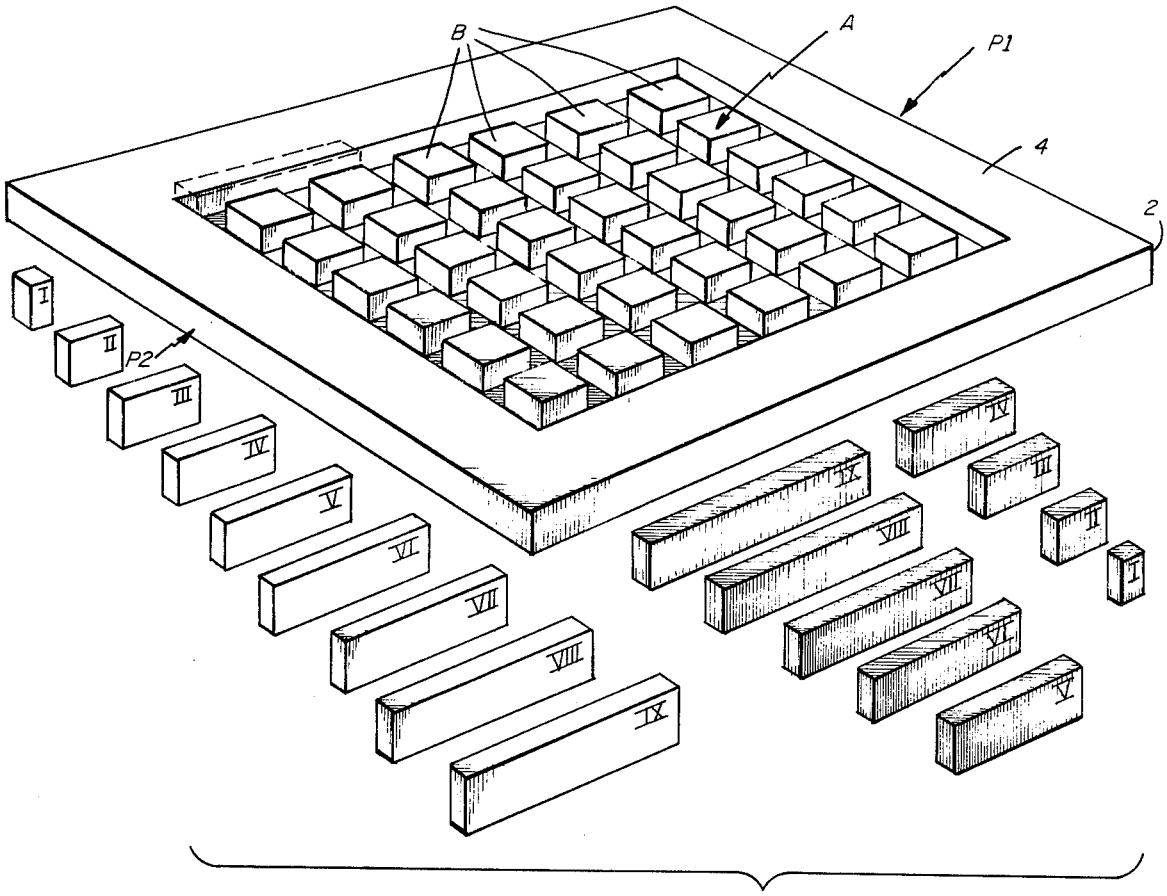
FIG. 1 is a perspective view illustrating the game board of the invention together with two sets of game pieces which can be moved over the board.
Figure 2:
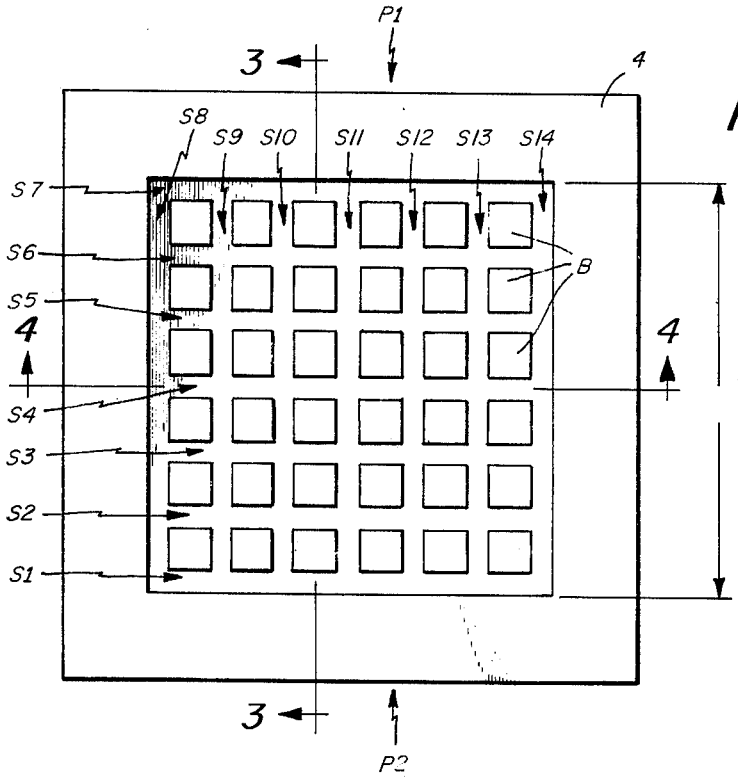
FIG. 2 is a plan view of the board illustrated in FIG. 1 and indicating one playing side at the top of the Figure and the other playing side at the bottom of the Figure.

The game of the invention is quite simple in concept and consists of a playing board and two sets of game pieces. However, the board and the game pieces are dimensionally related to one another in a unique manner, as hereinafter described, so that placement of game parts is characterized by a variety of interesting and challenging moves. The playing board is constructed to have two opposite playing sides and is designed to be played by two players only positioned oppositely to one another. In one desirable arrangement, the playing board can be supported on a table or other suitable surface on which the two sets of game pieces may also be received at either side of the playing board in some convenient location.

At its upper side, the playing board is recessed to form a playing area in which are provided two sets of uniformly spaced apart, intersecting slideways for receiving game pieces. The slideways all have a common width and this slideway width constitutes an important unit dimension from which is derived a predetermined size for the playing area and predetermined dimensions for the game pieces.

Each set of game pieces is constructed in uniformly graduated lengths and may be formed of wood, plastic, and the like, so that a variation in color or appearance is present, enabling game pieces of one set to be readily distinguishable from those of the other set. An important characteristic of the game pieces is that the length of each piece in a set is based on the unit dimension noted above and the pieces differ in length progressively one from another by the said unit dimension.

The object of the invention is to achieve a combined placement of pieces in abutting relation to one another and in a position to span and fully occupy slideway spaces extending from one playing side of the board to an opposite playing side, either in direct alignment or in a staggered arrangement. Placement of pieces is carried out by each of the players in alternate turns and the moves which can be made are regulated by rules of play noted below.

Referring more in detail to the drawings, numeral 2 denotes the playing board which is of generally square configuration and presents two playing sides indicated by the arrows P1 and P2. As earlier noted, the playing board has its upper surface recessed. There is thus formed an outer marginal portion 4 which extends inwardly from edges of the board to define an enclosed playing area indicated by the arrow A. The playing area is comprised of two sets of uniformly spaced apart, intersecting slideways separated by rows of spacing blocks generally denoted by the arrow B, and most clearly shown in FIG. 1.

As shown in FIG. 3, one set of slideways extends between the playing sides P1 and P2, and are denoted by numerals S1, S2, S3, S4, S5, S6 and S7. The second set of slideways, extending at right angles to the first set, are shown in FIG. 4 and are denoted by numerals S8, S9, S10, S11, S12, S13 and S14. Spaces at the four corners of the playing area, it will be noted, are common to a slideway of each set.

The width of each slideway, as earlier suggested, is an important dimension and is the same for both sets and may, for example, have a unit dimension of three-eighths of an inch. The depth of each slideway is also three-eighths of an inch, and these dimensions are more clearly indicated in FIG. 3. Each set of slideways includes seven separated slideways, and extending between each pair of slideways are rows of the blocks B, each of which is cubical and has a width and length corresponding to two unit dimensions, or three-quarters of an inch, as indicated in FIG. 3. Thus, it will be observed, in accordance with the invention, there is provided a predetermined playing distance equal to nineteen of the unit dimensions or a span of seven and one-eighth inches. This is a minimum distance which is required to be spanned and fully occupied by game pieces to achieve a game-winning placement.

Considering next the two sets of game pieces shown in FIG. 1, the set at the left hand side of FIG. 1 may be referred to as white game pieces, and the set at the right hand side may be referred to hereinafter as black game pieces.

In each set, there is included a total number of nine pieces bearing Roman Numerals I – IX. Each piece has a thickness of one unit dimension, or three-eighths of an inch, so that each piece of either color is engageable in any of the slideways of either set. The depth of game pieces is chosen to exceed the depth of a slideway and, for example, may be of a depth of five-eighths of an inch to extend above the blocks one-quarter of an inch. There is thereby provided a convenient finger-gripping portion for picking up or moving any game piece to be engaged in and moved along a slideway.

An important feature of the invention is the provision of two sets of game pieces occurring in graduated lengths such that the game pieces in each set differ progressively one from another by a unit dimension corresponding to the width of a slideway, namely, three-eighths of an inch. Thus, the first piece of a set, which is indicated by Roman Numeral I, has a length equal to one unit dimension, or three-eights of an inch. Successive pieces in the set increase in length progressively one from another by a unit dimension of three-eighths of an inch so that the second piece, II, is two unit dimensions, or three-quarters of an inch long; the third piece is three unit dimensions, or one and an eighth inches long; etc.

In each set, therefore, there is a total number of unit dimensions of forty-five, from which varying combinations may be selected to obtain a total of nineteen units in order to span the space between the playing board sides and achieve a game-winning placement of pieces in alignment with one another. As an example of winning combinations of pieces which may be selected from either set, attention is directed to FIGS. 5, 6 and 7 wherein it will be observed that one winning combination is comprised by the three pieces numbered IX, VIII, and II, illustrated diagrammatically in FIG. 5. Similarly, in FIG. 6, game pieces numbered VII, VI, IV, and II are shown in a winning placement. In FIG. 7, still another combination of pieces, I, III, IV, V, VI, is illustrated.

In FIGS. 8, 9 and 10, winning combinations are illustrated of end-to-end connecting pieces that have a non-linear configuration. Thus, two parallel lines of pieces are connected by a third intersecting piece to achieve the winning combinations.

Prior to play beginning, each player is required to familiarize himself with certain regulations and restrictions. Only two players may participate and these two players take positions at two opposite playing sides of the board. Each player takes turns in successive alternating moves. The moves may take place in slideways extending between the two playing sides of the board, hereinafter described as "vertical" slideways, or in slideways extending parallel to the playing sides, hereinafter referred to as "horizontal" slideways.

The player, having elected to play with a set of game pieces of one color, or other identifying medium, may, therefore, select pieces from that set only, and may not move or capture pieces from the opponent's set. Placement of pieces by either player must be in accordance with Rules of Play noted below to achieve a "legal" placement, and when this is not the case, the placement is "illegal" and can be protested by an opponent.

RULES OF PLAY

As play begins, the playing board is clear of all pieces, and a set of one color such as "white" pieces, and a set of a different color such as "black" pieces, is selected by the players by consent or toss of a coin. In a first game, white pieces move first. If another game is played, black pieces move first, and for every successive game, the turn alternates.

Each move of a player in turn No. 1 requires that the player start with piece No. V. Starting with turn No. 2, the player can use pieces I to IV in any order. Regardless of the turn number, the player shall not use pieces VI through IX until he has played all of the shorter pieces I to IV. At this time only, he is permitted to play pieces VI through IX in any order, and will be allowed to enter a new mode of play referred to as "Pick and Place Mode" only after using all four of the larger pieces.

As noted above, each player, as soon as all nine of his pieces have been placed on the board, may adopt a different mode of play which is referred to as the "Pick and Place Mode". In this mode of play, a player is permitted to remove an already placed piece from a slideway and legally place it somewhere else on the board, as described below in more detail. The Pick and Place mode can start after a minimum of nine turns, or a greater number of turns may be used where a player elects a double slide turn, as provided in the rules noted below. One more option open to a player is that of removing a piece totally from the board and reserving it for later use.

RULES REGARDING PLACEMENT AND SLIDE OF PIECES

During placement of all of the nine pieces by each player necessary before the "Pick and Place" mode of play begins certain requirements must be observed.

Every placement of a piece onto the board in the slideways, with the exception of the first piece, must fully contact an already placed piece of the same color. For every turn up to until the Pick and Place mode begins, a player, for his move, is allowed not only a regular placement, but also a slide of either the newly placed piece or any of his already placed pieces. This is illustrated in FIGS. 15 – 18 in which FIG. 15 illustrates an arrangement of black pieces in which arrangement Black may place a piece *x*, as shown in FIG. 16, and then take a second part of his turn by electing to slide *x* into a new place as shown in FIG. 17. FIG. 18 suggests an alternate choice where Black leaves piece *x* and slides another piece *g*. A slide of an already placed piece means that it can be pushed in the slideway which it occupies in either direction to the extent that no physical obstruction of another piece or the end of the slideway interferes. This is illustrated in FIGS. 19 – 22 in which FIG. 19 illustrates a starting arrangement of black and white pieces. FIG. 20 illustrates white piece *k* slid as far as the free slideway permits with a black piece in a blocking position. In FIG. 21, white piece *t* has been moved to the end of its slideway. FIG. 22 illustrates white piece *u* in a pinned or completely blocked position from which it cannot be slid.

One or more pieces of the same color that are abutted end to end by contact may be slid as if they were just one very long piece, counting as just one slide toward the moves quota of development. This is illustrated in FIG. 23 in which pieces *i* and *h*, in end to end contact, may be slid together counting as one slide.

Each player is allowed a move consisting of two phases through the first nine turns. They are (a) legal placement; (b) a slide; done in either order. Or, in lieu of a placement, a player may elect to take two separate slides of two different pieces. This option is termed a "double slide". This is illustrated in FIGS. 24 to 26. In FIG. 24, a starting arrangement of black and white pieces is shown. In FIG. 25, White places and slides a piece *h*, while Black slides piece *d* first, and then places piece *o*. In FIG. 26 White, from the starting arrangement of FIG. 24, elects to slide both of his pieces.

Two placements by a player for his move is strictly forbidden. It should also be mentioned, it is permissible for a player to forego part or all of his turn.

A move of placement and slide, or vice versa, does not necessarily mean that it has to involve conjoining pieces. By this it is meant that any pieces of the same color, regardless of proximity, are permitted to be used by a player in any turn in question.

The placements and slides of all pieces require, as earlier noted, that the butt ends of the pieces are in flush alignment with either the ends or exact middles of the unit squares B. Hence, no overreaching into a slideway is permitted.

When a piece is placed onto the board, it must fit into a space chosen for it without being physically blocked by an already-placed piece of either color. Sometimes it is possible to make room for a piece by first sliding an interfering piece out of the way and then making the placement.

RULES CONCERNING LEGAL PLACEMENT IN HORIZONTAL AND VERTICAL SLIDEWAYS

A placement will be deemed legal if it conforms with the Rules above-stated together with the further provisions and restrictions hereinafter set forth.

There is no restriction on the number and color of pieces placed onto vertical slideways. This is illustrated in FIG. 27 by white and black pieces appearing therein.

The horizontal slideways, however, (with exceptions) are to be occupied by only one piece regardless of color. Therefore, once a piece has been placed into a horizontal slideway, it effectively reserves the entire slideway from further placements. This does not means, however, that pieces may not cross this slideway in the vertical direction. This is illustrated in FIGS. 28 to 30. FIG. 28 is a starting arrangement of pieces. FIG. 29 shows an illegal placement of pieces which have been located in the same horizontal slideways. FIG. 30, in comparison, shows a legal placement of pieces across *c*'s slideway, as well as that of *f*.

The first exception to this preceding rule is that in the center horizontal slideway, one of each player's pieces is allowed to occupy a slideway. This is illustrated by the white and black pieces in FIG. 31.

Another exception to the preceding rule arises from the special privileges granted to piece I, sometimes called the "Roamer". This piece is allowed to go anywhere on the board. For example, the roamer is allowed to be placed in a horizontal slideway already occupied by a piece of the same color, and a larger piece of the same color may be placed in a horizontal slideway already occupied by a roamer. This is illustrated in FIGS. 32 and 33. The roamer, piece I, neither restricts nor is restricted from horizontal placement by pieces of either color.

Thus in the center horizontal slideway a total of four placements is allowed: two regular pieces of different color, as explained above, and both pieces referred to as roamers as explained above. This is illustrated in FIG. 34.

Also the roamer (I) is free to slide along both horizontal and vertical slideways. In essence, the roamer is unique in that it can turn corners. This is illustrated in FIG. 35. Piece I will, however, not be permitted to restrict or reserve a horizontal row from placement of an opponent's piece.

Possible options are illustrated in FIGS. 11 and 12. In FIG. 11 a typical arrangement of black and white pieces is shown. FIG. 12 illustrates black taking his turn by sliding piece *m* across a slideway for a single slide, and in FIG. 13 black has elected to pick up and remove the piece *y*. In FIG 14, black elects to pick up piece *x* and place it in another slideway.

A draw may occur once the "Pick and Place" mode has been reached. If one player believes the game to be drawn, (e.g. all routes for possible linking end to end connections are blocked by the opponent for each player) he so states it. If the other player agrees, the game is over. If he does not, the first player can start a seven-play draw count-down in which the player who believes it is not a draw is permitted to obtain a victory within his seven moves. If he cannot win as they play on for seven more turns, the game is called a draw.

A variation to this is if during the seven turns, the player who originally called for the draw may see a situtation develop that changes the state of affairs (this being that his opponent's defense has been weakened), he can then immediately call the count-down off and play resumes in the Pick and Place mode either two-way victory, another draw count-down, or a draw.

Summarizing these rules and regulations, each player must have all nine pieces on the board before he can adopt the Pick and Place Mode. Prior to this, each player is allowed a move which includes (a) legal placement; (b) a slide; or in lieu of a placement, a player may elect two separate slides of two different pieces. When the Pick and Place mode begins, a player may pick up a piece and place it elsewhere without taking a slide of that piece or any other piece, but the player is given the option of taking a double slide instead of a single slide if he foregoes the Pick and Place. It is pointed out that although a piece must initially contact its own color piece as it is placed into a slideway, it need not remain there and can be slid away to a place of effective separation by use of the second phase of that same turn.

From the foregoing description, it will be apparent there has been disclosed an improvement in the field of games and it will be seen that manipulating the game components in accordance with the rules and regulations specified entails an interweave of offensive and defensive plays. It is to a player's advantage to negotiate the type of moves that will undertake both functions to a certain degree. This is true because a player has only a limited number of pieces and moves during the course of a game. During any game, crucial considerations involve judgment in the timing or sequence of tactics, the soundness and balance of early game structure, extension of forces beyond the opponent's defense, weakening of the opponent's extension possibilities, and a constant anticipation of the most penetrating routes for a bridging piece connection. Control of the center is not necessary, but one should keep some concentration near the center.

I claim:

1. A game playable by two opposing players, said game consisting of a playing board having two opposite playing sides and spaced apart intersecting slideways located between said sides, and a set of game pieces for each player engageable in the slideways, said game pieces occurring in uniformly graduated lengths, and game pieces of each graduated set differing in length progressively one from another by a unit dimension corresponding to the width of one of the slideways, differing combinations of pieces for each set being combinable on the board in abutting relationship by a player to extend from one of the playing sides to the other playing side to constitute a game-winning placement of pieces.

2. A game playable by two opposing players, said game consisting of a playing board having two opposite playing sides spaced apart a predetermined distance and being formed with uniformly separated intersecting slideways located between the playing sides, and two sets of game pieces of uniformly graduated lengths engageable in the slideways, a plurality of game pieces selected from each set being combinable on the board in abutting relationship by a player to span the said predetermined distance between the playing sides, and said game pieces of each graduated set differing progressively one from another by a unit dimension corresponding to the width of one of the slideways.

3. A game playable by two opposing players consisting of a playing board and two sets of game pieces movable on the board, said playing board comprising a base member presenting four equal sides and having on its upper surface a continuous outer margin extending inwardly from each of the four sides to provide inner marginal edges which define an enclosed playing area, portions of the board lying inside the marginal edges being recessed to form two sets of slideways, uniformly spaced apart and occurring at right angles to one another, game pieces in each set occuring in uniformly graduated lengths, pieces of selected lengths from each set being engageable in the slideways in abutting relationship to one another in a position to span the space between two opposite sides of the playing area and thereby to constitute a game-winning placement of pieces.

4. The invention of claim 3 in which the game pieces of each graduated set differ progressively one from another by a unit dimension corresponding to the width of said slideways.

5. The invention of claim 4 in which two opposite sides of the said playing area are spaced apart a distance equal to nineteen (19) of the unit dimensions.

6. The invention of claim 5 in which each set of game pieces are graduated in unit dimensions of from one to nine, and bear respective numbering at outer sides thereof.

7. The invention of claim 6 in which each of the sets of slideways are separated by block portions having a width and length corresponding to two unit dimensions.

8. A game playable by two opposing players and consisting of a playing board and two different sets of game pieces movable on the board between players from two opposite playing sides of the board, said playing board comprising a flat substantially square base member whose outer edge portions include the said opposite playing sides and two additional sides extending at right angles between respective ends of the playing sides, said base member at its upper surface presenting a continuous outer margin extending inwardly from each of the sides to define an enclosed playing area, portions of the base member lying inside the said outer margin being recessed to provide two sets of uniformly spaced apart slideways, one of said sets extending between inner marginal edges of the said two playing sides at a level below the surface of the outer margin and the other of the two sets extending at right angles to the said first set, each of the slideways having a common width of a predetermined unit dimension, and a common length equivalent to a predetermined number of said unit dimensions, and each of said sets of game pieces including a plurality of game pieces which have a common width equal to the said unit dimension of the slideways width and which occur in predetermined graduated lengths beginning with a length equal to a single unit dimension and increasing by said unit dimension in arithmatical progression, from which graduated lengths differing combinations of pieces may be located on the playing surface in the slideways in uninterrupted abutment with one another and with the marginal edges of the two playing sides.

* * * * *